US007360512B1

(12) United States Patent
Asmus et al.

(10) Patent No.: US 7,360,512 B1
(45) Date of Patent: Apr. 22, 2008

(54) LOW-THERMAL-INERTIA INTAKE PORTS FOR PORT-INJECTED, SPARK IGNITION ENGINES AND AN ASSOCIATED MANUFACTURING METHOD

(75) Inventors: Thomas W. Asmus, Oakland, MI (US); Michael A. Bonne, Leonard, MI (US)

(73) Assignee: Chrysler LLC, Auburn Hills, MI (US)

( * ) Notice: Subject to any disclaimer, the term of this patent is extended or adjusted under 35 U.S.C. 154(b) by 0 days.

(21) Appl. No.: 11/615,042

(22) Filed: Dec. 22, 2006

(51) Int. Cl.
*F02F 1/40* (2006.01)

(52) U.S. Cl. ..... 123/41.56; 123/41.62; 123/310; 123/41.79

(58) Field of Classification Search ..... 123/41.56, 123/41.62, 41.76, 41.77, 41.79, 310
See application file for complete search history.

(56) References Cited

U.S. PATENT DOCUMENTS 3,989,424 A * 11/1976 Goloff et al. ..... 418/83
4,182,282 A * 1/1980 Pollet ..... 123/41.76
4,300,494 A 11/1981 Graiff et al.
4,785,773 A 11/1988 Schreiber et al.
5,099,808 A 3/1992 Matsuura et al.
5,551,385 A 9/1996 Yoshida et al.
5,842,342 A 12/1998 Strasser et al.
5,875,754 A 3/1999 Ickinger
6,729,272 B2 * 5/2004 Iizuka et al. ..... 123/41.84
7,069,884 B2 * 7/2006 Baba et al. ..... 123/41.82 R
7,191,740 B2 * 3/2007 Baba et al. ..... 123/41.82 R

* cited by examiner

*Primary Examiner*—Stephen K. Cronin
*Assistant Examiner*—Jason Benton
(74) *Attorney, Agent, or Firm*—Ralph E. Smith

(57) ABSTRACT

The present invention provides an intake port design that provides a low thermal inertia characteristic, thereby decoupling the surface temperature of the intake port walls from that of the coolant through use of an air gap formed between the intake port and the cylinder head. At idle and part-throttle, the intake port is at a higher surface temperature yielding better cold-start emissions, better mixture preparation, and less dense intake charge ("thermal throttling") for better fuel economy. At wide-open-throttle, the intake port is at a lower surface temperature yielding better volumetric efficiency for improved torque and reduction in knocking tendency enabling higher compression ratio for improved fuel economy and performance. The intake port design of the present invention can be manufactured with a hydroform manufacturing process resulting in improved dimensional consistency and smooth surface finish. Additionally, the process eliminates some cylinder head machining processes.

12 Claims, 6 Drawing Sheets

LOW-THERMAL-INERTIA INTAKE PORTS FOR PORT-INJECTED, SPARK IGNITION ENGINES AND AN ASSOCIATED MANUFACTURING METHOD

FIELD OF THE INVENTION

The present invention relates generally to a cylinder head intake port design in a port-injected, spark ignition engine, and more particularly to a concept for an intake port of low thermal inertia decoupling the surface temperature of the intake port from that of the coolant, and a manufacturing process to form the low-thermal-inertia intake port.

BACKGROUND OF THE INVENTION

It is well established that certain critical portions of the fuel-air mixing process can be influenced by the thermal environment wherein fuel and air first come into contact with each other, i.e., the intake port. While the air that passes through the intake port is only slightly influenced by the temperature of the intake port walls, any liquid fuel that exists as a film on the intake port wall will be significantly affected by the temperature. Thus, the liquid-vapor equilibrium and the mixing process will be affected by this.

The temperature of the intake port walls can influence the heat flux from the walls to any liquid fuel films. Conventional design practice places the intake port in direct contact with engine coolant, and therefore the temperature is governed principally by that of the coolant with a slow warm up period and a near constant temperature thereafter throughout the engine operating regime.

Further, conventionally designed intake ports are manufactured with a port-core casting technique which utilizes relatively large wall thicknesses surrounded by engine coolant, resulting in a high degree of thermal inertia. Also undesirable are locational and dimensional variability and relatively "rough" surface finish associated with the port-core casting technique.

Disadvantageously, the slow warm up and constant temperature of conventional intake ports is not ideal with respect to emissions, fuel efficiency, and performance. Thus, there exists a need to thermally decouple the temperature of the intake port walls from the engine cooling system to align the temperature closer to idealized thermal conditions for intake ports. Further, there exists a need for a manufacturing process for the thermally-decoupled intake port which adds an air gap between the intake port walls and the cylinder head surface while providing a more uniform and polished surface from the port-casting technique used in conventional intake ports.

U.S. Pat. No. 5,099,808 to Matsuura et al. discloses a cylinder head assembly with intake ports having a thermally insulated barrier made of a ceramic material covering the intake port wall for purposes of reducing air flow resistance by reducing heat transfer between the cylinder head and the inducted air. However, the Matsuura et al. reference fails to disclose thermally decoupling the surface temperature of the intake port wall from the coolant in order to match ideal thermal characteristics of an intake port. Further, the Matsuura et al. reference fails to disclose a hydroform manufacturing process to form a low-thermal-inertia intake port.

BRIEF SUMMARY OF THE INVENTION

The present invention provides an intake port design with a low thermal inertia characteristic, thereby decoupling the surface temperature of the intake port from that of the coolant through use of an air gap between a portion of the intake port wall and cylinder head. Because of this thermal decoupling, at idle and part-throttle, the intake port is at a higher surface temperature yielding better cold-start emissions, better mixture preparation, and less dense intake charge ("thermal throttling") for better fuel economy. At wide-open-throttle, the intake port is at a lower surface temperature yielding better volumetric efficiency for improved torque and reduction in knocking tendency enabling higher compression ratio for improved fuel economy and performance.

The intake port design of the present invention can be manufactured with a hydroform manufacturing process resulting in improved dimensional consistency and smooth surface finish. Additionally, the process eliminates some cylinder head machining processes. Further, this process manufactures the intake ports without significant cost differences from conventional port manufacturing processes.

In an exemplary embodiment of the present invention, a low-thermal-inertia intake port for a port-injected, spark ignition engine includes intake port walls disposed within a cylinder head such that an air gap is formed between the intake port walls and the cylinder head, and the air gap extends from above a valve seat at a downstream end of the intake port to below an upstream end of the intake port. The air gap is operable to thermally decouple the temperature of the intake port walls from the temperature of the engine providing thermal characteristics mimicking ideal thermal characteristics for intake port walls. The ideal thermal characteristics of the walls of the intake port relative to an engine coolant include higher surface temperature at idle and part-throttle, and lower surface temperature at wide-open throttle. The walls of the intake port include pre-formed sheet metal. The low-thermal-inertia intake port further includes a valve guide located in a hole punched within the pre-formed sheet metal, and the valve guide includes an aperture adapted for receipt of a stem portion of an intake valve therethrough. The low-thermal-inertia intake port also includes a valve seat at a downstream opening of the intake port operable to control the selective flow of air and fuel through the intake port cooperative with an intake valve. Optionally, the valve guide and valve seat are furnace brazed to the pre-formed sheet metal. Advantageously, the compression ratio is raised by between one-half and about one full ratio in a port-injected, spark ignition engine equipped with a plurality of low thermal inertia intake ports.

In another exemplary embodiment of the present invention, a method of operating a port-injected, spark ignition engine with a plurality of low-thermal-inertia intake ports includes the steps of heating the walls of the plurality of low-thermal-inertia intake port during cold start and warm-up relative to the engine coolant, conveying heat to liquid fuel films residing in the intake ports during light load, and minimizing heat flux from the port walls to the liquid fuel films at high load and low-to-mid speed operating conditions. Each of the plurality of low-thermal-inertia intake ports include intake port walls disposed within a cylinder head such that an air gap is formed between the intake port walls and the cylinder head, and the air gap extends from above a valve seat at a downstream end of the intake port to below an upstream end of the intake port. The air gap is operable to thermally decouple the temperature of the intake port walls from the temperature of the engine providing thermal characteristics mimicking ideal thermal characteristics for intake port walls. Advantageously, the compression ratio of the port-injected, spark ignition engine is raised to an extent that the knock tendency is the same as an engine equipped with conventional intake ports without low thermal inertia.

In yet another exemplary embodiment of the present invention, a manufacturing method for a low-thermal-inertia intake port for a port-injected, spark ignition engine includes the steps of hydroforming steel tubing to form intake port walls for the low thermal inertia intake port, punching a valve guide hole in the hydroformed steel tubing, furnace brazing an intake valve guide and valve seat to the hydroformed steel tubing, adding core sand to the furnace brazed and hydroformed steel tubing, performing aluminum casting, and removing the core sand through a deliberate opening. Further, the manufacturing method includes the step of machining the inner surface of the valve seat and the stem portion of the valve guide.

BRIEF DESCRIPTION OF THE DRAWINGS

The present invention is illustrated and described herein with reference to the various drawings, in which like reference numbers denote like system components and/or method steps, respectively, and in which.

DETAILED DESCRIPTION OF THE INVENTION

Figure 1:
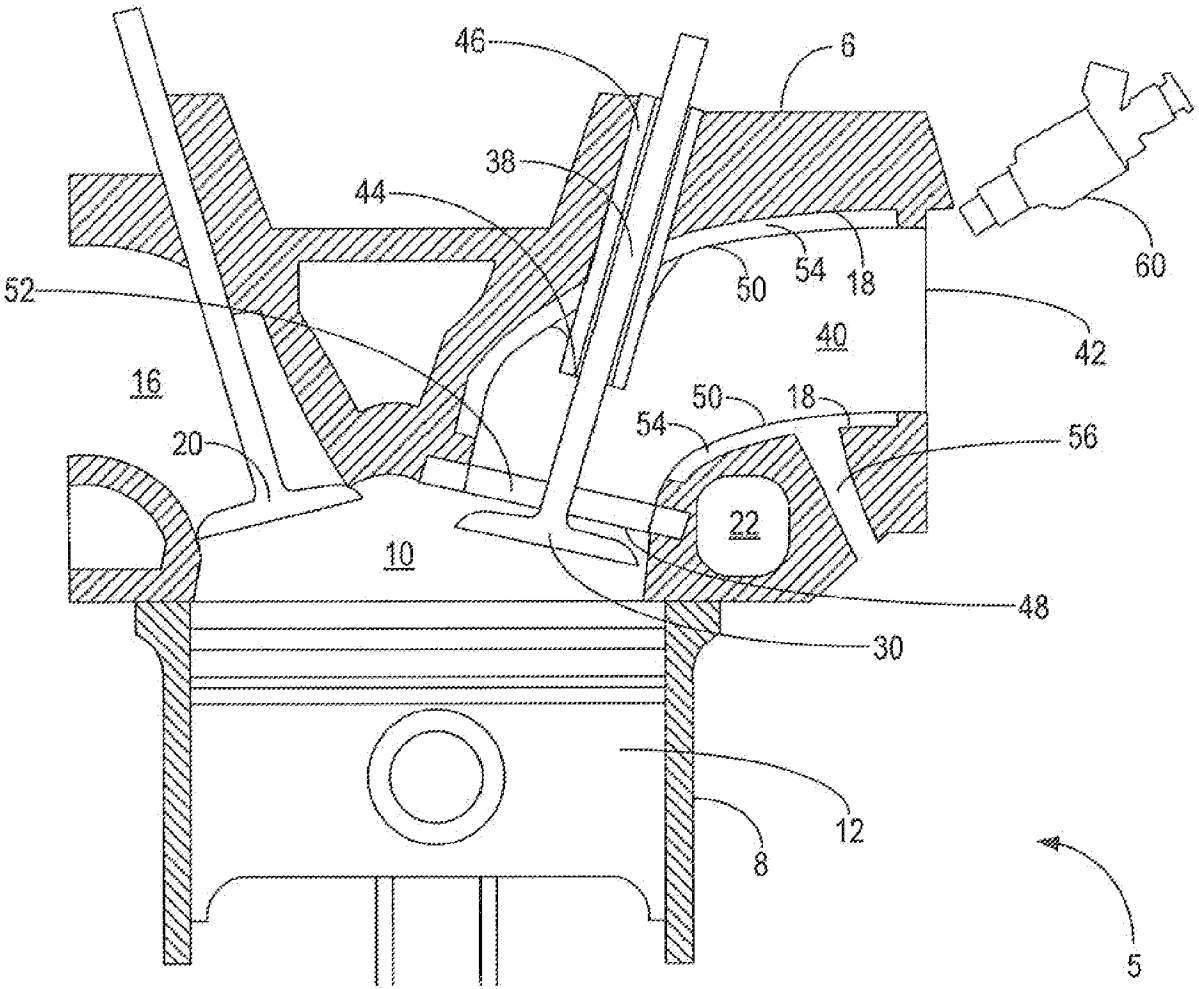
FIG. 1 is a sectioned view of a port fuel-injected, spark ignition engine illustrating one cylinder bore formed in an engine block.

In various exemplary embodiments, the present invention provides an intake port design and associated manufacturing method with a low thermal inertia characteristic, thereby decoupling the surface temperature of the intake port from that of the coolant through use of an air gap formed between a portion of the intake port wall and cylinder head. Because of this thermal decoupling, at idle and part-throttle, the intake port is at a higher surface temperature yielding better cold-start emissions, better mixture preparation, and less dense intake charge ("thermal throttling") for better fuel economy. At wide-open-throttle (WOT), the intake port is at a lower surface temperature yielding better volumetric efficiency for improved torque and reduction in knocking tendency enabling higher compression ratio for improved fuel economy.

Idealized thermal conditions for intake port walls may be characterized as follows for cold start and warm-up, light load operation, and high load and low-to-mid speed operation. During cold start and warm-up, it is desirable for the intake port walls to heat up as rapidly as possible relative to the engine coolant to promote fuel vapor formation during this thermal transient period where exhaust emissions of carbon monoxide and hydrocarbons are a dominant concern. This will reduce the enrichment required to promote sufficiently homogeneous mixture formation to support robust combustion.

During light load operation where knock is not an issue, it is desirable to convey as much heat as possible to liquid fuel films residing in the intake ports to help ensure maximum charge homogeneity to support emissions-related goals, and to lower the charge density as much as possible through heating and thus to reduce the need for pressure throttling which is responsible for the so-calling pumping loss (this may be termed thermal 'throttling'). This will reduce fuel consumption at those operating conditions where pumping losses are high, i.e., at typical low-speed cruise conditions.

At high load and low-to-mid speed operating conditions where knock is a critical issue, it is desirable to minimize heat flux from the port walls to the liquid fuel films to reduce charge temperatures and thus to reduce the knock tendency. This then can enable the use of higher-than-normal compression ratios which supports improved fuel efficiency and performance. At the same time, the knock tendency is reduced by reduced charge temperatures, and volumetric efficiency is increased thereby increasing engine performance over the entire speed range.

These aforementioned attributes can be realized by thermally decoupling a portion of the intake port from the engine cooling system. A low-thermal-inertia intake port of the present invention provides a surface temperature of the interior walls that is high at low load and low at high load relative to the engine coolant. In various exemplary embodiments, the low-thermal-inertia intake port includes an air gap formed between the intake port walls and the surfaces of the cylinder head, and the air gap is operable to decouple the surface temperature of the intake port from the coolant or cylinder bore.

Referring to FIG. 1, a sectioned view of a port fuel-injected, spark ignition engine 5 illustrates one cylinder bore 8 formed in the engine block. The cylinder bore 8 partially defines a combustion chamber 10 along with a piston 12 which reciprocates in the cylinder bore 8. At the upper portion of the engine block, a cylinder head 6 closes the cylinder bore 8. The cylinder head 6 includes a coolant passage 22. An exhaust port 16 enables the selective discharge of exhaust gasses from the combustion chamber 10. An exhaust valve 20 controls the selective flow of exhaust gasses cooperative with a valve seat (not shown) through the exhaust port 16.

A low-thermal-inertia intake port 40 of the present invention selectively supplies a flow of air and fuel into the combustion chamber 10. A valve seat 52 cooperative with an intake valve 30 controls the selective flow of air and fuel through a downstream opening 48 of the intake port 40. A stem portion 38 of the intake valve 30 extends through an aperture 44 through a valve guide 46 in the intake port 40.

A fuel injector 60 is configured to spray fuel into the interior of the intake port 40. Air and fuel are introduced into the combustion chamber 10 during an intake stroke after the intake valve 30 moves into an opened position. As described herein, the temperature of the intake port 40 significantly affects the temperature of any liquid fuel that exists as a film on walls 50 of the intake port 40 while the air that passes through the intake port 40 is only slightly influenced by the temperature of the intake port walls 50. Thus, the liquid-vapor equilibrium and the mixing process will be affected by the temperature of the intake port walls 50.

As described herein, not all exhaust gas flows through the exhaust port 16 during the combustion cycle. Some hot residual gas flows from the combustion chamber into the intake port 40 as intake valve lift begins. The low-thermal-inertia intake port 40 utilizes this naturally occurring event to align its temperature characteristics to aforementioned idealized thermal characteristics.

According to an exemplary embodiment of the present invention, the low-thermal-inertia intake port 40 is configured to thermally decouple the surface temperature of the intake port 40 from that of the engine coolant by introducing an air gap 54 to act as a thermal barrier between the intake port walls 50 and the cylinder head 18. This air gap 54 decouples the temperature to achieve aforementioned attributes of idealized thermal conditions for intake port walls 50. Advantageously, the air gap 54 provides much less thermal inertia than other conventional methods such as ceramic lining within the intake port 40.

In one exemplary embodiment, the air gap 54 is formed from above the valve seat 52 at the downstream end 48 to just below the upstream end 42. Based on experimentation, the air gap 54 width can be above 1 mm to properly decouple the thermal characteristics of the intake port walls 50 from the cylinder head 18. A sheet metal tube or the like is included in the intake port sand core such that the air gap 54 results between the intake port walls 50 and the parent metal of the cylinder head 18. The intake port walls 50 can be pre-formed sheet metal or a formed, sheet metal hollow intake valve. A core sand exit 56 is also formed in the cylinder head 18 extending from the air gap 54 to allow for the exit of core sand following a casting process.

Figure 2:
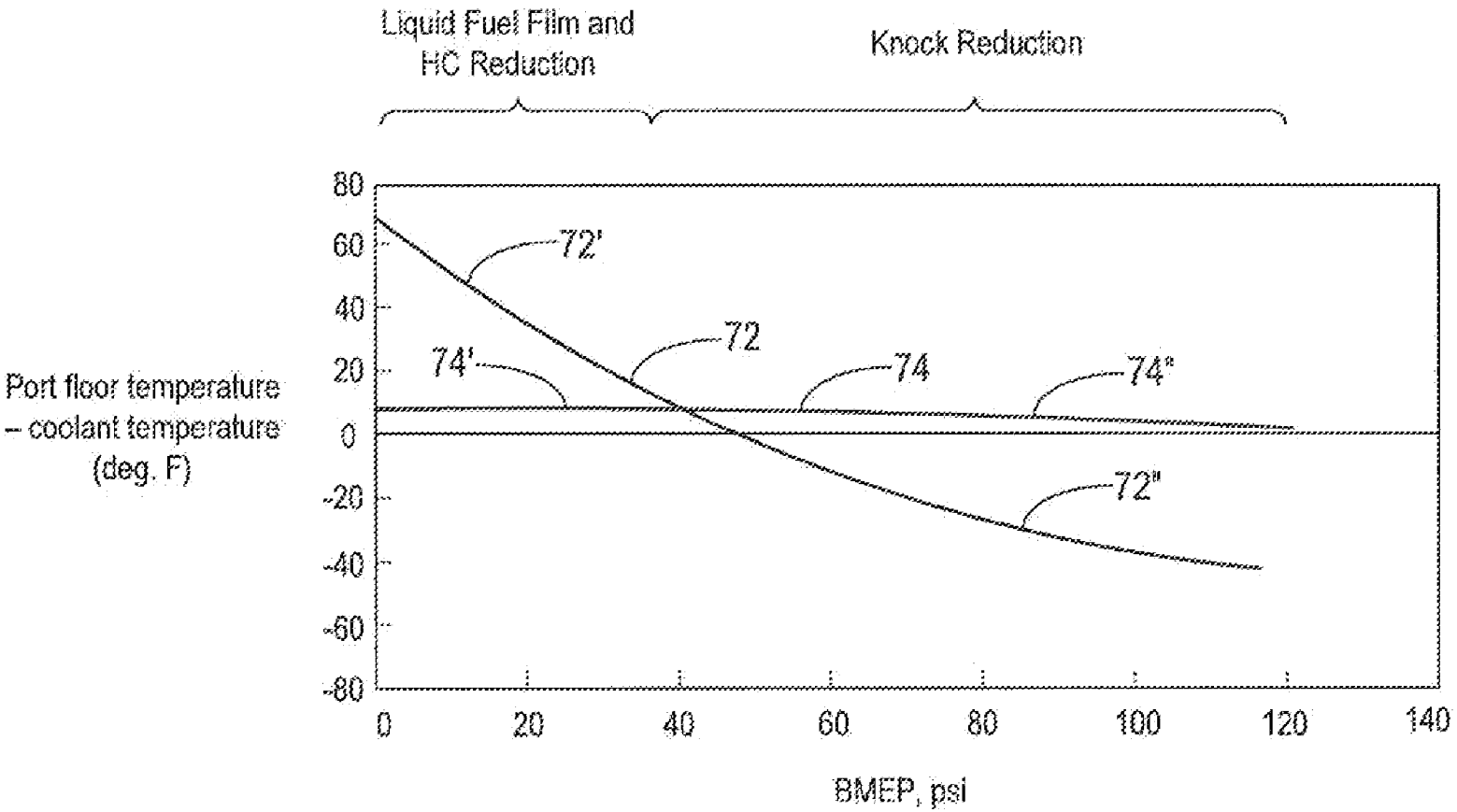
FIG. 2 is a graph showing the observed effect of engine load on intake port temperature of a low-thermal-inertia intake port and a conventional intake port.

Referring to FIG. 2, the observed effect of engine load on intake port surface temperature of a low-thermal-inertia intake port is hotter at lighter load and cooler at higher loads than a conventional intake port. FIG. 2 illustrates a graph of the port floor temperature referenced to the coolant temperature as the load increases (brake mean effective pressure (BMEP) measured in psi).

Engine operating condition influences the mixture preparation process largely by the attendant residual gas content of the charge, i.e., the hot residual gas content of the charge increases as load and speed decrease. Other factors such as valve overlap, equivalence ratio, exhaust gas recirculation (EGR) levels, and ignition timing also affect this. Hot residual gas flows from the combustion chamber into the intake port as intake valve lift begins. This is a pressure-driven back-flow, and at very light loads it will be a high velocity flow with significant turbulent mixing potential. During the cold startup process, mixture preparation is hindered by the combination of cold fuel and cold air coming together in a cold intake port.

At low speed and low engine load, i.e., low BMEP of around 0 to 40 psi in FIG. 2, engine operation involves substantial residual (i.e., exhaust that did not make it out of the exhaust port) gas back-flow into the intake port, and the air flow through the passage is relatively low and the port walls are subject to heating. As a consequence, the mean surface temperature of the port walls and intake valve can be expected to increase even greater than the mean surface temperature of a conventional intake port without an air gap. This effect is shown by the leftward portion 72' of line 72 in FIG. 2 with line 72 representing the temperature of the walls of a low thermal inertia port according to the present invention minus the engine coolant temperature. As described herein, heating of the air and fuel mixture is desirable under these conditions as the tendency to knock is low, and the heating promotes lower emissions through liquid fuel film and hydrocarbon reduction and other good driveability characteristics. The leftward portion 74' of line 74 depicts the temperature expected in a conventional port, which is close to the same temperature as the coolant as expected.

As the load increases, i.e., BMEP above 40 psi, the low-thermal-inertia intake port surface temperature is expected to decrease as illustrated in the rightward portion 72" of line 72. Here, the effect of the above described exhaust gas backflow are substantially decreased while a greater air flow through the intake port tends to decrease the mean surface temperature of the port walls. Accordingly, the temperature of the fluid flow into the combustion chamber decreases. This lowering of the temperature permits an engine to be designed with an increased compression ratio without risking a knocking problem. Specifically, line portion 72' shows the cooler surface port temperature of a low-thermal-inertia intake port of the present invention versus a convention port which is shown in the rightward portion 74" of the convention port line 74.

Advantageously, the compression ratio can be raised to an extent that the knock tendency is the same as the baseline configuration (i.e., conventional port without low thermal inertia). If the charge (i.e., fuel/air mixture and residual gas) temperature is reduced by approximately 40° F. at full load of 120 psi BMEP as shown in FIG. 2, then the compression ratio can be raised by as much as one full ratio. This potentially corresponds to a fuel economy benefit of about 4% and a performance increase of about 2-3%.

Figure 3A:
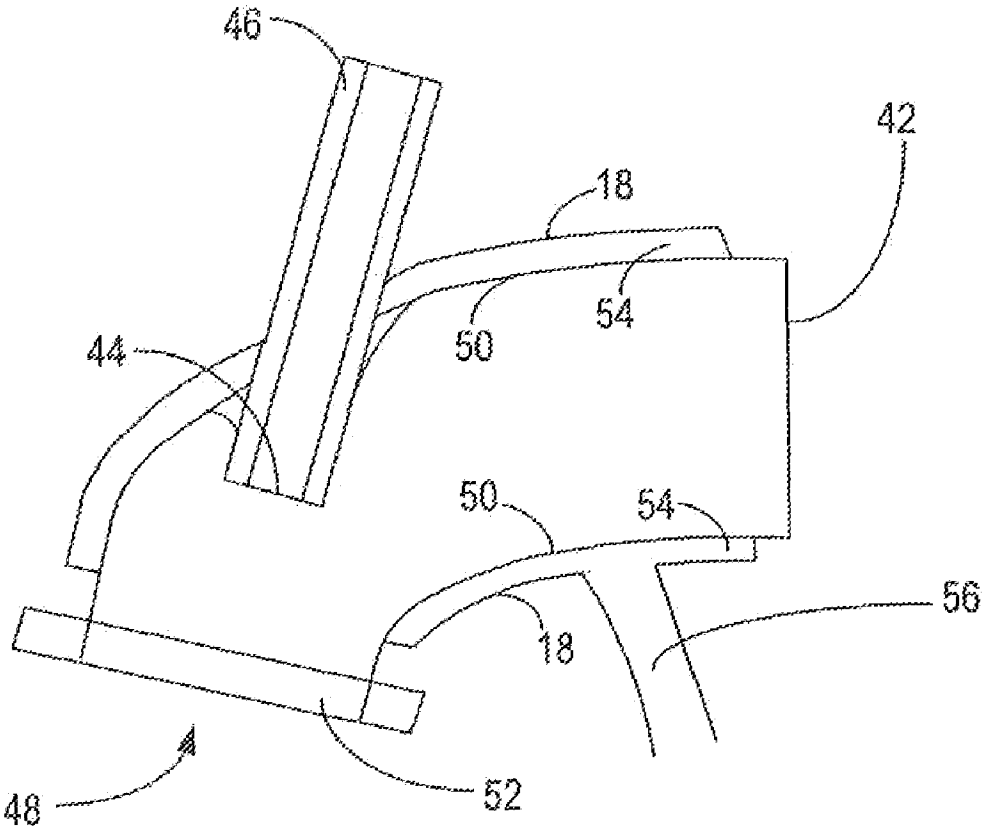
FIGS. 3*a*-3*c* are sectional and perspective views of a low-thermal-inertia intake port according to an exemplary embodiment of the present invention.
Figure 3C:
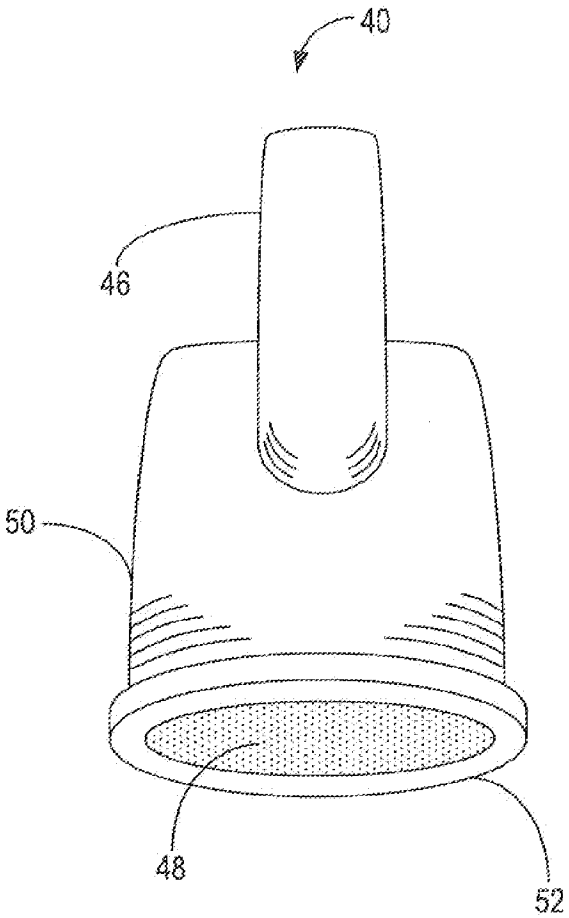
Figure 3B:
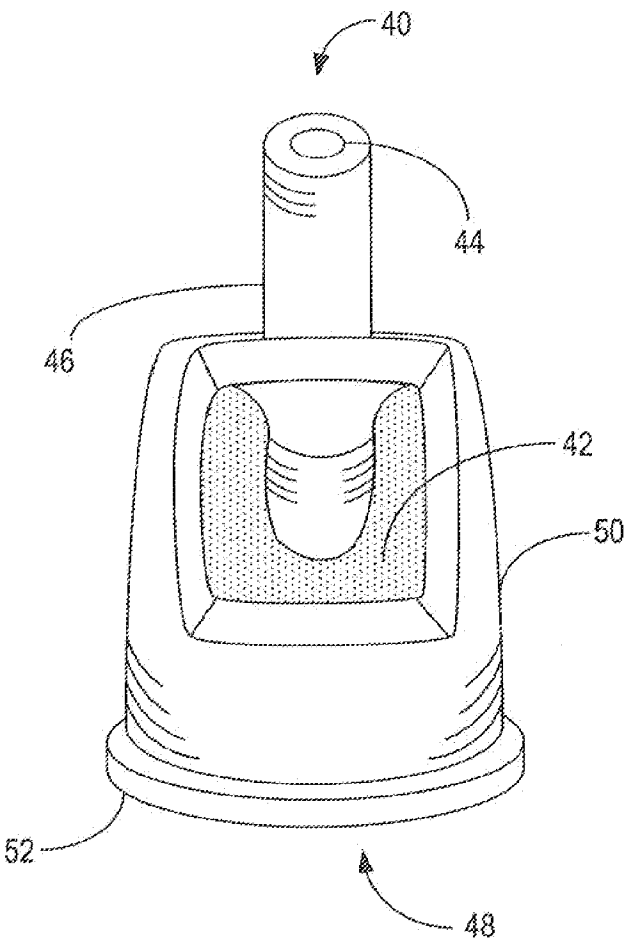

Referring to FIGS. 3*a*-3*c*, the low-thermal-inertia intake port 40 of the present invention includes the air gap 54 between the intake port walls 50 and the cylinder head 18 for thermal decoupling. FIG. 3*a* illustrates a sectional view of the low-thermal-inertia intake port 40. FIGS. 3*b* and 3*c* illustrate a front and back perspective view of the low-thermal-inertia intake port 40 not included in the cylinder head.

As described herein, the low-thermal-inertia intake port 40 includes a valve seat 52 located at the downstream end 48. The valve seat 52 forms the opening to the intake port 40 along which is opened and closed by the intake valve. Air flows into the intake port 40 at the upstream end 42, and the valve guide 46 extends outward from the intake port 40 and includes the aperture 44 which the stem portion of the intake valve fits into.

The intake port walls 50 can be a pre-formed sheet metal that is included in the intake port sand core such that at least a 1 mm air gap 54 results between the intake port walls 50 and the parent metal of the cylinder head 18. The intake port walls 50 are anchored into the cylinder head 18 material, i.e., aluminum or the like, just above the intake valve seat 52. The core sand exit 56 is included in the casting process to allow core sand to exit from the intake port walls 50 after casting. Alternatively, the intake port walls 50 could be relatively open at the upstream end 42 to allow for core sand removal after casting through the core sand exit 56, i.e., the intake port walls 56 are not attached to the cylinder head 18 at the upstream end 42 where the intake manifold attaches. The intake manifold gasket port openings (not shown) would surround the upstream end 42 of the port walls 50 giving it stability and alignment with the intake manifold runner windows (not shown). Further, this effect may be enhanced by using a formed sheet metal hollow intake valve.

Figure 4A:
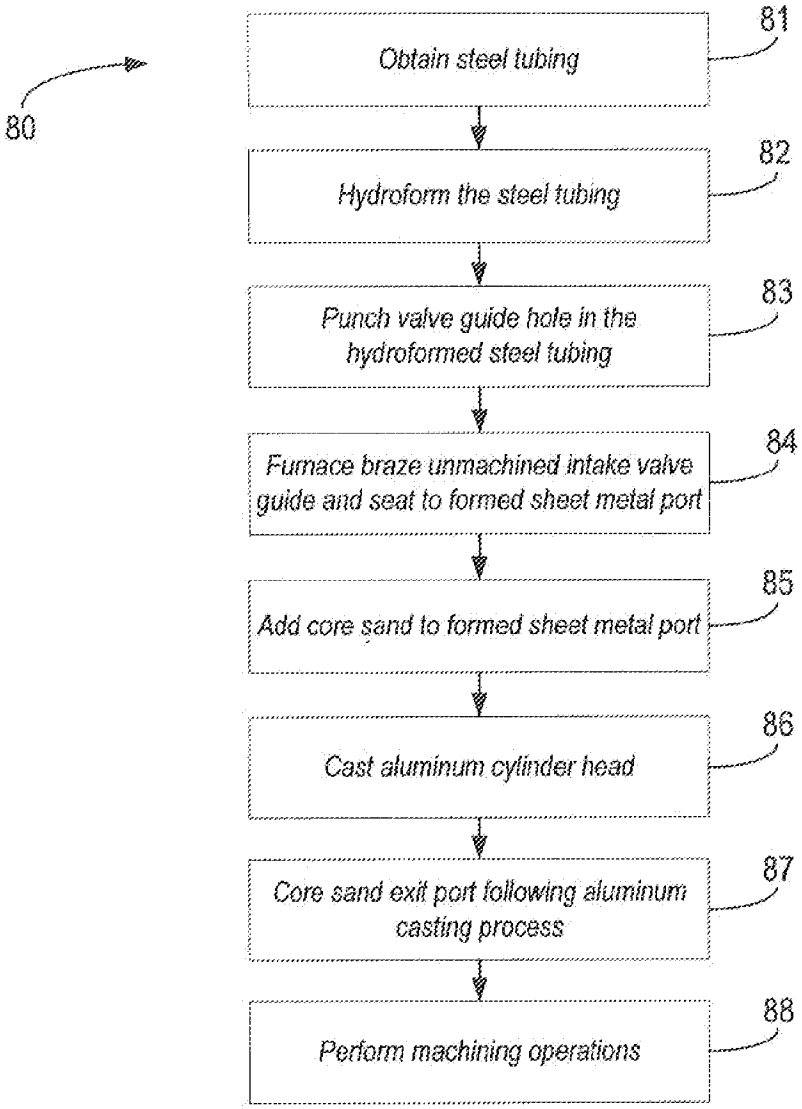
FIGS. 4*a*-4*f* are a flowchart and perspective views illustrating a manufacturing process for low thermal inertia intake ports according to an exemplary embodiment of the present invention.

Referring to FIGS. 4*a*-4*f*, a practical and cost-effective method 80 to manufacture the low-thermal-inertia intake port 40 involves a hydro-forming technique that advantageously results in improved dimensional consistency and eliminates some cylinder head machining processes. FIG. 4*a* is a flowchart of the manufacturing method 80 and FIGS. 4*b*-4*f* illustrate perspective views of the various steps in method 80.

Figure 4B:
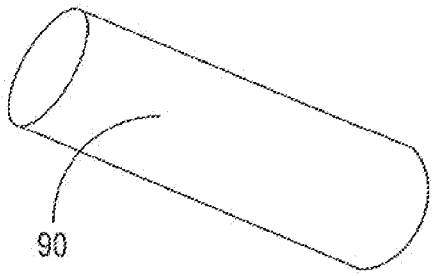
Figure 4C:
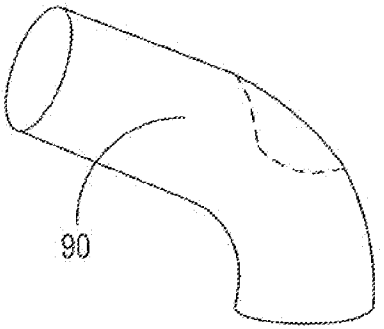

Manufacturing method 80 begins by obtaining steel tubing, as depicted in step 81. FIG. 4*b* illustrates steel tubing 90 as depicted in step 81. The steel tubing is hydroformed into the shape required of the port walls, as depicted in step 82. FIG. 4*c* illustrates the hydroformed steel tubing 90. Hydroforming is a cost-effective way of shaping malleable metals into lightweight, structurally stiff and strong pieces. Advantageously, hydroforming allows tighter control of the tolerances of the port walls allowing less variation and flow problems in the intake ports over conventional designs. This method provides similar benefits to polishing the ports as is done in high end engines such as ones used in racing. Conventional ports have a rough and non-uniform surface texture, while the method 80 of the present invention provides a smooth and uniform surface for the interior port walls through hydroforming.

Figure 4D:
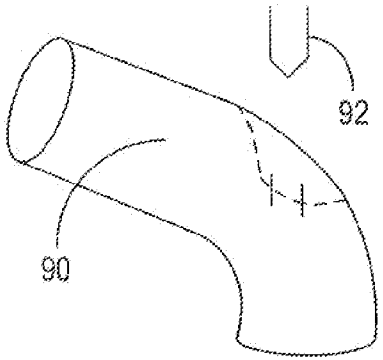

A valve guide hole is punched into the hydroformed steel tubing, as depicted in step 83. FIG. 4*d* illustrates punching a valve guide hole in the steel tubing with a punch 92. As described herein, the valve guide is where the stem portion of the intake valve fits. Advantageously, this step is a cost effective method to get a hole in the hydroformed steel tubing.

Figure 4E:
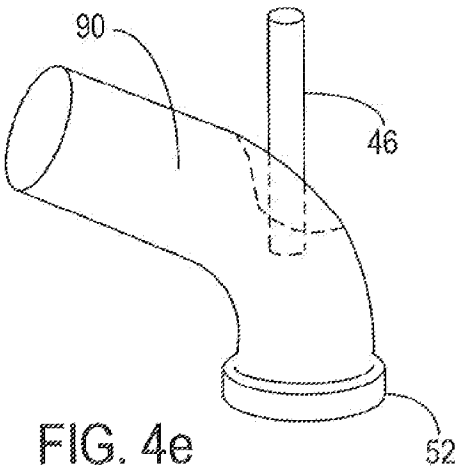

An un-machined intake valve guide and valve seat are furnace brazed to the formed sheet metal port, as depicted in step 84. FIG. 4*e* illustrates the valve guide 46 and valve seat 52 joined to the formed sheet metal port 90 by furnace brazing. Brazing is a joining process whereby a metal or alloy is heated to melting temperature (e.g., above 450° C.; 800° F.) and distributed between two or more close-fitting parts by capillary action. Additionally, the valve guide and valve seat can also be as-formed. Advantageously, the furnace braze-step of the intake valve guide 46 and seat 52 is cost-effective, and it eliminates a machining step.

Figure 4F:
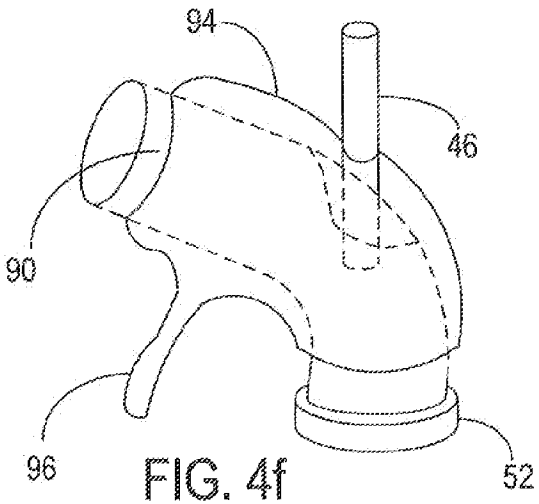

Core sand is added to the furnace-brazed, formed sheet metal port, as depicted in step 85. FIG. 4*f* illustrates the addition of core sand 94 to the formed sheet metal port. The formed sheet metal port with the valve guide 46 and valve seat 52 are wrapped with core sand in such a manner that much of the intake port walls upstream of the valve seat 52 is backed by atmospheric air instead of a thick cast wall and coolant.

The aluminum cylinder head is cast, as depicted in step 86. Note this is an un-machined step. While this structure involves an added steel part (i.e., intake port walls), it eliminates several machining operations inherent in conventional port designs as the valve seat 52 and valve guide 46 are cast into the parent metal (i.e., aluminum or the like) of the cylinder head. Additionally, the method 80 provides cost-effective and efficient means to form a thermally-insulating barrier as opposed to conventional means such as lining the intake port.

The core sand exits the casting through a deliberate opening following the aluminum casting process, as depicted in step 87. An opening 96 to the atmosphere is provided for the exit of core sand used to form the thermally decoupled portion of the port. Finally, remaining machining operations are performed such as machining the inner surface of the valve seat and the stem portion of the valve guide, as depicted in step 88.

Effectively, the method 80 forms a low-thermal-inertia intake port of the present invention by integrating a formed steel part (i.e., the intake port walls) with some attachments (i.e., valve seat and valve guide) into the cylinder head structure. As described herein, this method 80 is cost-effective by forming the air gap without requiring a liner, and the method 80 provides a smoother and consistent finish of the intake port.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A low-thermal-inertia intake port for a port-injected, spark ignition engine comprising:

intake port walls disposed within a cylinder head such that an air gap is formed between the intake port walls and the cylinder head;

wherein the air gap extends from above a valve seat at a downstream end of the intake port to below an upstream end of the intake port;

wherein the air gap is operable to thermally decouple the temperature of the intake port walls from the temperature of the engine providing thermal characteristics mimicking ideal thermal characteristics for intake port walls.

2. The low-thermal-inertia intake port of claim 1, wherein the ideal thermal characteristics of the walls of the intake port relative to an engine coolant comprise higher surface temperature at idle, and part-throttle and lower surface temperature at wide-open throttle.

3. The low-thermal-inertia intake port of claim 1, wherein the walls of the intake port comprise pre-formed sheet metal.

4. The low-thermal-inertia intake port of claim 3 further comprising a valve guide located in a hole punched within the pre-formed sheet metal, wherein the valve guide comprises an aperture adapted for receipt of a stem portion of an intake valve therethrough.

5. The low-thermal-inertia intake port of claim 4 further comprising a valve seat at a downstream opening of the intake port operable to control the selective flow of air and fuel through the intake port cooperative with an intake valve.

6. The low-thermal-inertia intake port of claim 5, wherein the valve guide and valve seat are furnace brazed to the pre-formed sheet metal.

7. The low-thermal-inertia intake port of claim 6, wherein core sand is added to the preformed sheet metal, with the valve guide and valve seat furnace brazed to the pre-formed sheet metal.

8. The low-thermal-inertia intake port of claim 1, wherein the air gap is at least 1 mm.

9. A method of operating a port-injected, spark ignition engine with a plurality of low thermal inertia intake ports comprising the steps of:

heating the walls of the plurality of low-thermal-inertia intake port during cold start and warm-up relative to the engine coolant;

conveying heat to liquid fuel films residing in the intake ports during light load; and minimizing heat flux from the port walls to the liquid fuel films at high load and low-to-mid speed operating conditions.

10. The method of claim 9, wherein each of the plurality of low thermal inertia intake ports comprise:

intake port walls disposed within a cylinder head such that an air gap is formed between the intake port walls and the cylinder head;

wherein the air gap extends from above a valve seat at a downstream end of the intake port to below an upstream end of the intake port;

wherein the air gap is operable to thermally decouple the temperature of the intake port walls from the temperature of the engine providing thermal characteristics mimicking ideal thermal characteristics for intake port walls.

11. A manufacturing method for a low-thermal-inertia intake port for a port-injected, spark ignition engine comprising the steps of:

hydroforming steel tubing to form intake port walls for the low thermal inertia intake port;

punching a valve guide hole in the hydroformed steel tubing;

furnace brazing an intake valve guide and valve seat to the hydroformed steel tubing;

adding core sand to the furnace brazed and hydroformed steel tubing;

performing aluminum casting; and removing the core sand through a deliberate opening to form an air cap between walls of the low-thermal-inertia intake port and a cylinder head;

wherein the air gap extends from above a valve seat at a downstream end of the intake port to below an upstream end of the intake port; and wherein the air gap is operable to thermally decouple the temperature of the walls from the temperature of the engine providing thermal characteristics mimicking ideal thermal characteristics for intake port walls.

12. The manufacturing method of claim 11 further comprising the step of machining the inner surface of the valve seat and the stem portion of the valve guide.

* * * * *